United States Patent [19]

Carn

[11] 4,112,865

[45] Sep. 12, 1978

[54] NAVIGATION HARNESSES

[76] Inventor: Patrick Carn, Route de Benodet, 29000 Quimper, France

[21] Appl. No.: 780,073

[22] Filed: Mar. 22, 1977

[30] Foreign Application Priority Data

Mar. 23, 1976 [FR] France ..... 76 08298
Dec. 13, 1976 [FR] France ..... 76 37521

[51] Int. Cl.[2] ..... B63B 9/08

[52] U.S. Cl. ..... 114/270; 24/77 R; 24/230 AP; 114/39; 182/9; 224/5 BC; 244/151 A

[58] Field of Search ..... 114/39, 270; 244/151 R, 244/151 A, 151 B; 280/290; 224/5 BC, 6; 182/3, 4, 9; 24/77 R, 78, 230 A, 230 AS, 230 AP; 9/313, 336; 115/6.1

[56] References Cited

U.S. PATENT DOCUMENTS 2,430,985 11/1947 King ..... 244/151 A
2,834,083 5/1958 Newell et al ..... 24/77 R
3,034,596 5/1962 Twaits, Jr. ..... 182/3
4,047,255 9/1977 Kiefer ..... 115/6.1

FOREIGN PATENT DOCUMENTS 692,501 11/1930 France ..... 244/151 A

*Primary Examiner*—Stephen G. Kunin
*Assistant Examiner*—Stuart M. Goldstein
*Attorney, Agent, or Firm*—Weiser, Stapler & Spivak

[57] ABSTRACT

A harness for sail board operators including a chest belt and shoulder straps. A hook carried by a plate on the belt attaches to a connecting element whose other end is fastened to the rigging. The hook pivots about an axis between a hooked-up position and a released position for the connecting element. The connecting element provides the releasing pivot force and a rip cord activates the mechanism which causes the releasing pivotal movement.

10 Claims, 6 Drawing Figures

Fig.2
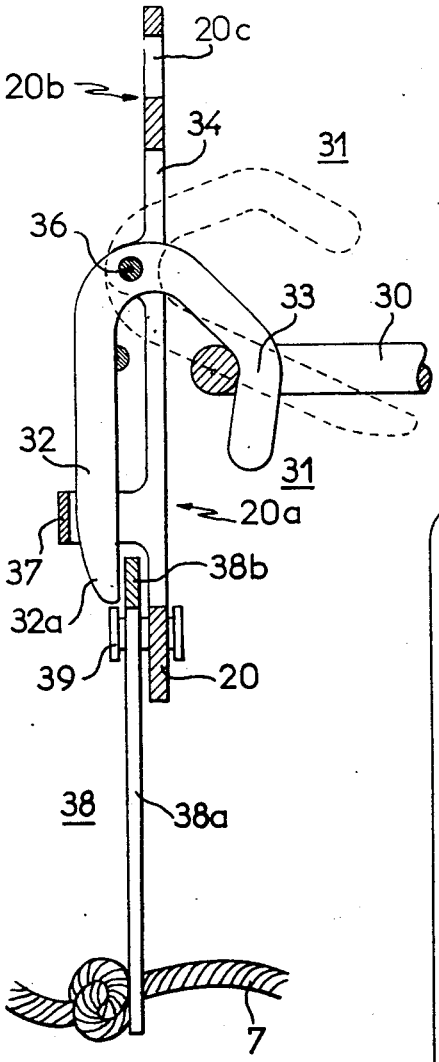
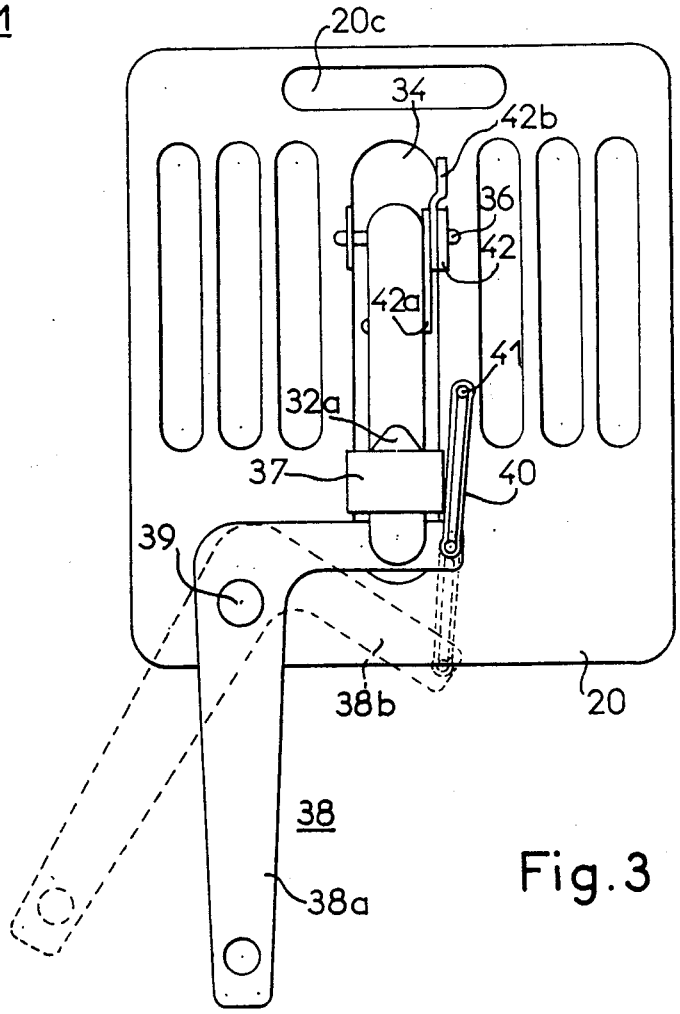
Fig.3

NAVIGATION HARNESSES

The present invention releates to improvements in harness type arrangements used particularly in navigation. Such harnesses are more particularly intended to reduce the muscular pulling efforts of the arms during navigation when one navigates, for example, a craft of the sail surfboard type or when one does water skiing.

It has been observed that sail surfboarding requires of the participant continuous muscular effort which limits the duration of participation in that sport.

As a general matter, various types of harnesses are already known such as those used in kecl boats wherein, in the position known as rappel, a trapeze is used. In that instance one encounters a conventional belt placed around the hips of the user and connected to the tackle of the craft by a line which is not instantaneously releasable.

Such a harness type is unsuitable for sail surfboarding because of the short distance between the participant and the tackle of the craft and the position of the torso practically parallel to the axis of the tackle in all attitudes of navigation.

Accordingly it is an object of the present invention to provide a safety harness intended particularly for sail surfboarding.

It is another object to provide such harness which noticeably reduces the arm muscle pulling efforts.

It is another object to provide such a harness with which, in case of danger such as loss of equilibrium leading to a fall, instantaneous release of the connection between tackle and participant is possible.

It is another object to provide a safety harness which, after release, makes possible the restoration of the harness-tackle connection without losing manual control of the craft's tackle.

It is another object of the invention to provide a harness which distributes better for the participant the stresses of keeping it under tension, protects the body, and in case of falling into the water, provides a reverse flotation vest to sustain the wearer on the surface of the water.

These and other objects are accomplished in accordance with the invention by improvements to a traction harness, particularly for use in navigation, and particularly for sail surfboarding, the harness comprising among other elements, a chest belt of adjustable length, provided with shoulder straps adjustable to the size of the user.

This belt is provided on the belly side, with a rigid plate having an attachment point for a releasable connection element by the user, for example a loop which may or may not be elastic, this element having an extremity attached to said point and another extremity attached to another portion of the craft, for example a part of the tackle.

These improvements are characterized by the fact that the attachment point of the releasable connecting element to the plate is formed by an open hook having an operating shank and a retaining portion for the connecting element, the hook being placed in a vertical slot provided within the plate in such manner that the retaining portion of the hook which receives the connecting element is oriented to protrude from the outer face of the plate.

The said hook is pivotally mounted traversing the vertical slot in the plate so as to occupy primarily two positions, one for attachment of the connecting element in which the retaining portion and the operating shank are in positions approximately parallel to the plane of the plate, the other of release for the connecting element in which the retaining portion and the operating shank of the hook are in a position approximately perpendicular to the plane of the plate.

Furthermore the release position of the hook for freeing the connecting element is controlled by the user, by simple pulling, by means of a rip cord acting upon the operating shank of the hook, the cord being connected to a body extremity of the user.

By virtue of this arrangement, the release hook which is worn by the user himself can easily be attached to the connecting element by movement of the user who is able to maintain during the hooking operation both hands gripping some part of the craft's tackle.

According to one embodiment of the invention the pivot axis of the hook for the connecting element is positioned above the level of the pulling point for said connecting element, thereby producing by pulling of the connecting element a couple tending to cause the hook to pivot from the hooked-on position to the release position. The hook is maintained in its hooked-on position by a control latch in the form of a two branch lever. One branch forms the latch and one branch provides the control. The lever is pivotable about an axis in a plane parallel to the plane of the plate, particularly under the action of the rip cord. The lever is capable of occupying two positions, one of operativeness in which the arm of the latch partially closes the slot in the plate to define a barrier for the operating shank of the pivotable hook, the other of retraction, in which the latch branch leaves free the passage of the hook's operating shank to pivot through the slot in the plate.

According to another embodiment of the invention the pivot axis of the hook is positioned upon the shank, below the level of the pulling point of the connecting element, on the retaining portion of said hook in such a manner that under the pulling forces exerted by the connecting element, the hook is subjected to a rotational couple holding the operating shank of the hook against the bottom of the plate. The relationship between the lever arms on opposite sides of the pivot axis of the hook are at least equal to or greater than two to one between the shank and the retaining portion. The release control of the connecting element is provided by a rip cord whose end is attached directly to the lower end of the hook shank.

According to an embodiment of the invention the harness takes the form of a protective and insulating vest. The chest belt and shoulder straps are placed upon the vest and a flotation reserve is provided upon that vest preferably at neck level.

Other features and advantages of the invention will appear from the detailed description of embodiments of the invention provided by way of example in the accompanying drawings wherein:

FIG. 2 is a cross section through the harness plate along II—II of FIG. 1;;

FIG. 3 is a rear view of the harness plate;

Figure 1:
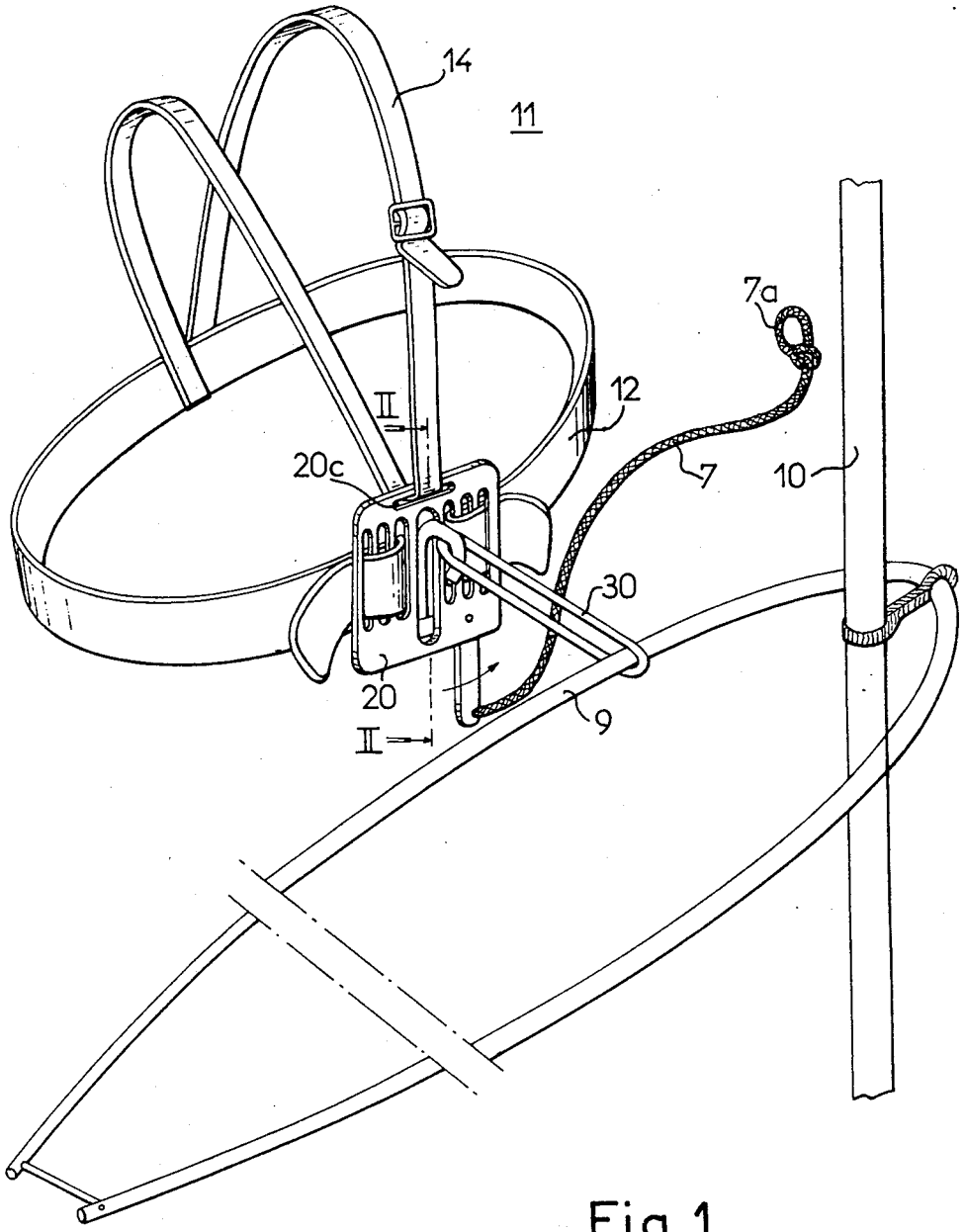
FIG. 1 is a perspective view showing the improved safety harness.

In the illustrative embodiment of FIG. 1 the harness is designated by general reference numeral 11. This harness comprises a chest belt 12 adjustable in length at its attachment location. The belt is provided with a pair of parallel shoulder straps adjustable to the size of the user.

The shoulder straps of the chest belt are constituted by a single strap whose extremities are connected by a buckle. The strap passes on the one hand around the chest belt in the middle of the rear portion of the belt and, on the other hand, through a horizontal slot 20*c* provided along the upper horizontal edge of the harness plate.

The belt includes a rigid plate 20 having an attachment portion for a connecting element 30 releaseable by the user. Preferably the connecting element 30 between plate 20 and a part of the craft is an elastic loop. This connecting element requires no length adjustment and remains attached in place, for example around the wishbone 9 when the craft is of the sailboard type.

Reference will now be made to FIGS. 2 and 3 to describe in detail the attachment point of the releasable element 30 to plate 20. This attachment point is constituted by an open hook 31 having a operating shank 32 and a retaining portion 33 for the connecting element 30.

The hook 31 is positioned within a vertical slot 34 provided in the plate. The retaining portion 33 of hook 31 which receives the connecting element 30 is oriented to protrude from the outer face 20*a* of the plate which is opposite to the belly face 20*b*.

Hook 31 is pivotally mounted about an axis 36 through slot 34. The shaft 36 is positioned appreciably above the pulling point of the releaseable element 30. In its pivotal movement the hook 31 can assume two distinct positions. A first position corresponds to hooking on of the connecting element 30. In that position, the retaining portion 31 and the operating shank 32 are in a position approximately parallel to the plane of plate 20. In the release position of the connecting element 30, the retaining portion 33 and the shank 32 of the hook are in a position approximately perpendicular to the plane of plate 20. Pivoting of hook 31 is limited in the direction of the belly face of plate 20 by a bridge 37 which straddles shank 32 of the hook to form a restraining member for the shank when it occupies a position substantially parallel to the plane of the plate.

The pulling forces exerted by the connecting element 30 upon the retaining portion 33 of the hook tend to make the latter pivot into the position represented in broken lines. To maintain the hook 31 in its operating position, which is also the hooked-on position for the connecting element 30, there is provided a latch 38 which can be controlled to achieve release of the connecting element 33. Latch 38 takes the form of an L-shaped bracket having a control branch 38*a* and a latching branch 38*b*. The bracket can pivot about a shaft 39 in a plane parallel to the plane of plate 20 and can thereby occupy two positions. In its first operating position, represented in solid lines, the latching branch 38*b* of the bracket partially closes slot 34 of hook 31 to form a restraining member to the passage of shank 32. The latching branch can also occupy a retracted position shown in dashed lines in which the said latching branch 38*b* of the bracket frees the passage for shank 32 of the pivotable hook which can then pass freely through slot 34 of the plate. The release control is achieved by a rip cord 7 whose end is attached to the control branch 38*a*, the other end of the cord being attached for example to a body extremity of the user as, for example, to one of his wrists. After each controlled release, bracket 38 resumes its operating position by means of a restoring means such as, for example, an elastic band 40 attached at one end to the free end of latching branch 31*b* of the bracket and on the other end to an attachment point 41 on the belly face of the plate.

According to another embodiment, shank 32 of the pivotable hook 31 has a control shank 32*a* which, after each release operation of the connecting element contacts the latching branch 38*b* of bracket 38. Branch 32*a* causes bracket 38 to pivot into the retracted position shown in dashed lines. The bracket resumes its operating position after passage of the shank 32 of the hook through the pass-through slot 43 of the plate. Automatic restoration of hook 31 is accomplished by a spiral spring 42 wrapped around shaft 36 of thepivotable hook. One branch of this spiral spring 42*a* bears upon shank 32 of the hook whereas its other branch 43*b* bears upon the belly face of plate 20. In this manner hook 31 is continuously urged towards its operating position.

Figure 4:
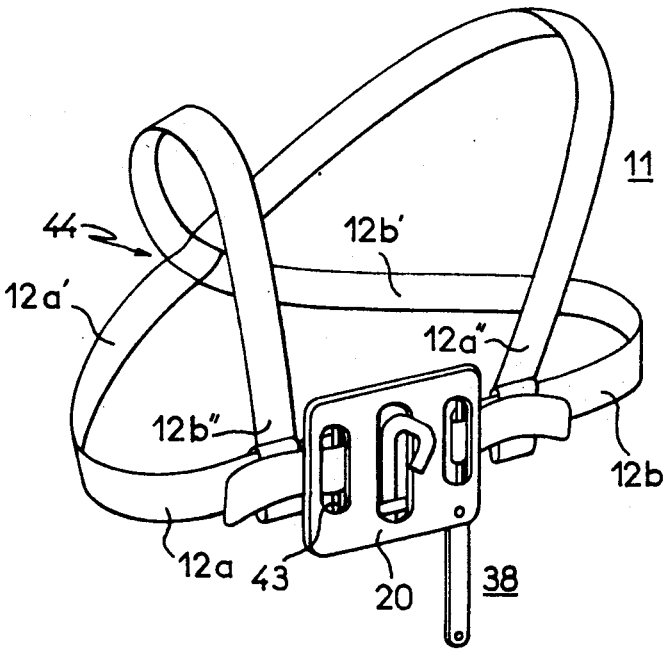
FIG. 4 is a perspective view showing another embodiment of the harness.

Although harness 11 shown in FIG. 1 is satisfactory there can also be provided the embodiment shown in FIG. 4 which makes possible good distribution of the pulling forces which act upon hook 31. To that end the chest belt consists of two opposing sections 12*a*, 12*b*, connected in length-adjustable manner to plate 20 via a buckling arrangement 43 which is known in itself.

Each section of the belt extends from plate 20 toward the back 44, bearing first upon the chest and then passing under the user's arm to then diagonally traverse the back so that the two sections 12*a*', 12*b*' cross upon back. Each section then passes over the shoulder to form shoulder straps whose extremities 12*a*" and 12*b*" are attached by being wrapped around the respective segments of belt 12*b*, 12*a*.

The harness according to the embodiments of FIGS. 1 through 4 functions as follows:

Having put on harness 11, the user passes loop 7*a* of cord 7 around his wrist. The user can hold on with both hands to the wishbone 9 and, by approaching the latter, through pulling with his arms can attach hook 31 of plate 20 to the loop formed by the elastic connecting element 30. If desired the user may assist this process with one hand without releasing the tackle in order to engage connecting element 30 with hook 31. The user can cause his craft to maneuver by controlling the tackle with his hands placed on either side of the connecting element upon the wishbone without having, as was the case previously, to hold his arms under tension. If he wants to free himself in case of falling, it suffices to pull upon cord 7 previously engaged by its loop around one of his wrists. As a result, this pull, acting upon branch 38*a* of bracket 38, produces retraction of the latching branch, freeing the shank of the hook which, under the influence of the couple exerted by the connecting element, pivots and frees the said connecting element. As soon as release of the connecting element is achieved, torsion spring 42 restores hook 32 into its operating position, ramp 32*a* of the shank causes the latching branch of the bracket to pivot and, after passage of the shank, to reassume its position as previously indicated. The hook is then latched in its operating position and the connecting element can then be attached to the retaining portion 33 of the pivotable hook. In the embodiment shown in FIGS. 5 and 6, the mode of execution used makes possible simplification of the bracket for the hook shank, eliminating the restoring spring for the said bracket, and eliminating the restoring spring for hook 31.

To that end, pivot shaft 36 of hook 31 is positioned upon shank 32 below the level of the pulling point P of connecting element 30 which is in contact with the retaining portion 33 of the hook.

Due to this, the pulling forces exerted by connecting element 30 subject hook 31 to a rotational couple tending to force shank 32 of the hook against the bottom portion 36*a* of plate 20. This yields immobilization of hook 31 in the hooked-on operating position of connecting element 30.

In this embodiment, release control of connecting element 30 is achieved by rip cord 7 which is attached directly to the lower end of hook shank 32.

To obtain release of connecting element 30 it suffices to exert a pull on cord 7 in order for the hook to assume the position shown in dashed lines.

In that position connecting element 30 escapes from retention by retaining portion 33 of the hook whose end 33*a* is internally shaped in the manner of a sliding ramp, promoting the freeing of the said connecting element.

In order that the user can obtain freeing of the connecting element with a moderate effort, the relationship of the lever arms on one side and the other of pivot shaft 36 of hook 31 is at least equal to or greater than two to one. In the example illustrated, lever arm $L_2$ has a length of the order of two and a half times the length of lever arm $L_1$. This proportion is given here only by way of illustration and it goes without saying that the relationship between lever arms $L_1$ and $L_2$ can be varied within wide limits.

The positioning of hook 31 can be similar to that in the first exemplary embodiment, being provided by a slot in plate 20 and a bridge straddling shank 32 to immobilize it in a position substantially parallel to the plane of the plate. According to a preferred embodiment of the invention the positioning of hook 31 is advantageously in the form of a recess provided by stamping along the entire height of the plate, thereby further reducing the manufacturing time of that plate.

Figure 5:
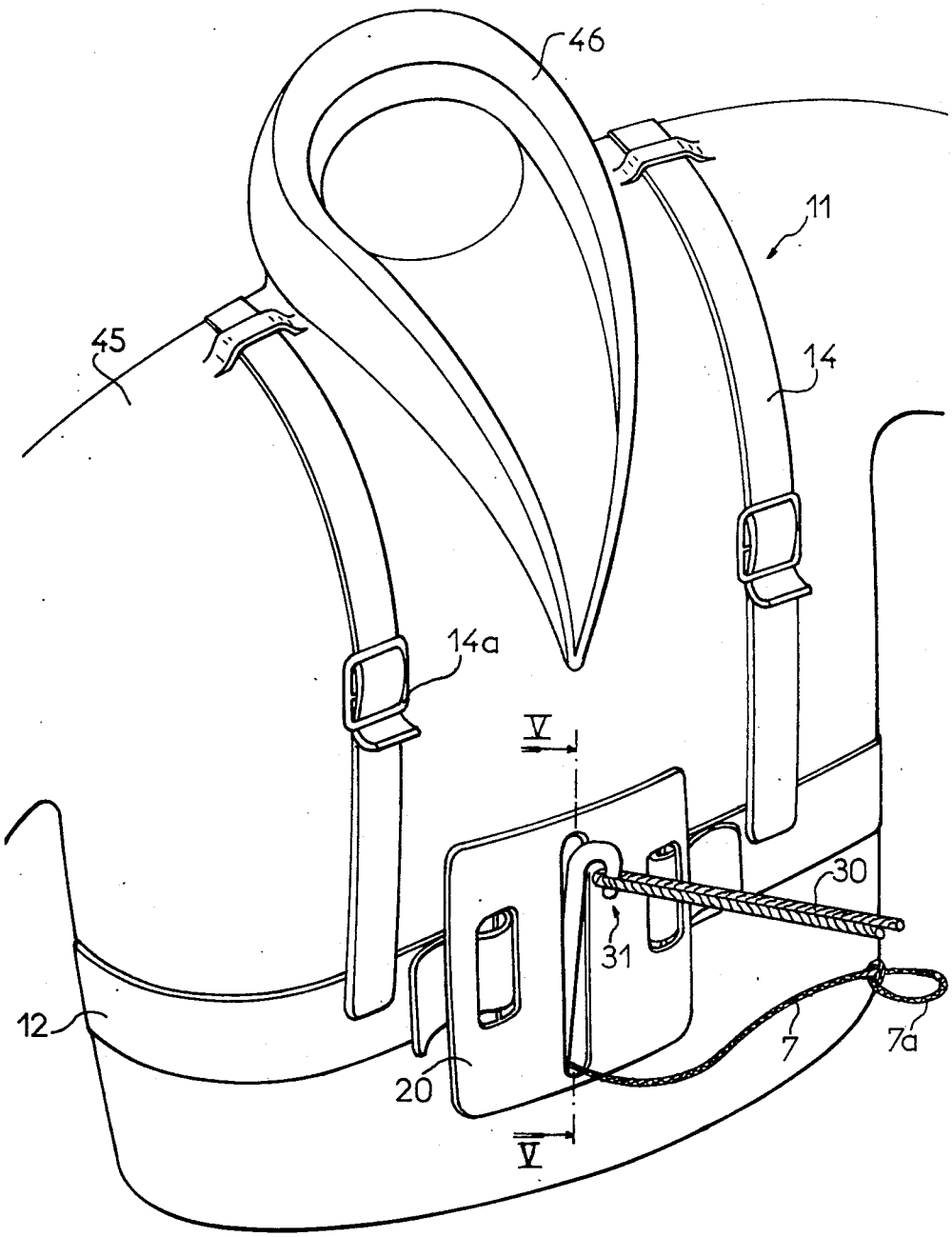
FIG. 5 is a perspective view showing the safety harness connected to a vest.
Figure 6:
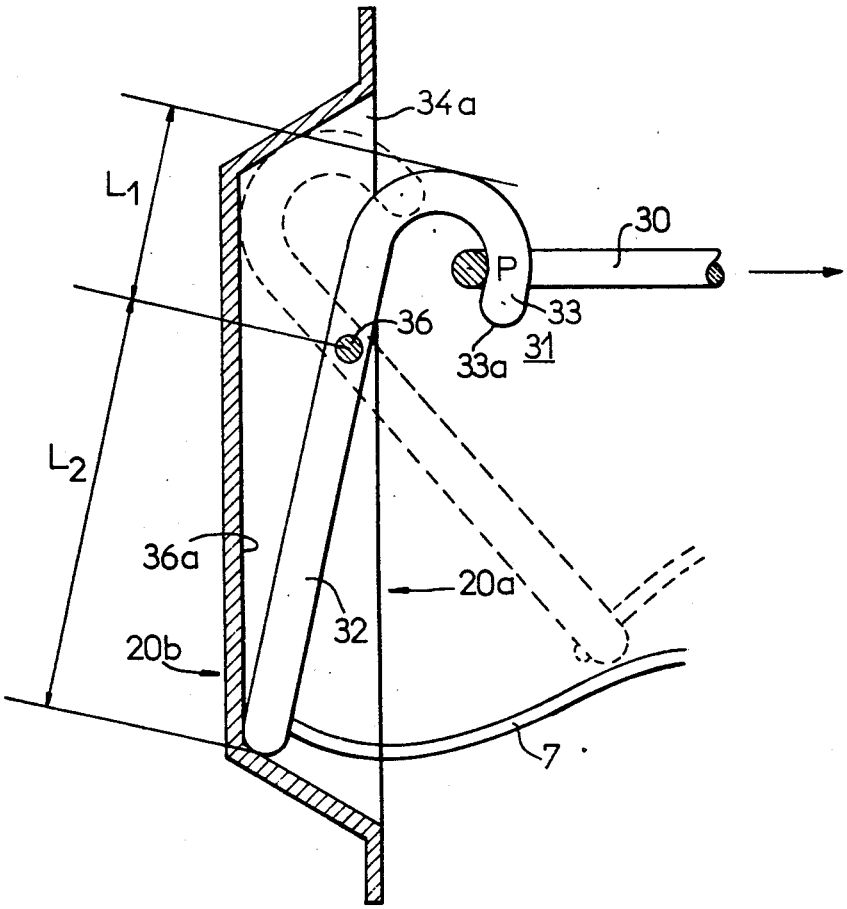
FIG. 6 is a sectional view along V—V of FIG. 5.

In the embodiment illustrated in FIG. 5 the harness is in the form of a protective and insulating vest 45. On this vest are positioned the chest belt 12 and shoulder straps 14. It will be noted that shoulder straps 14 are provided with adjusting buckles 14*a* to adjust the height of the chest belt 12 to that which is best suited to the functioning of the hook of the plate both for its hooked-on position and for the release position of the connecting element 30.

Advantageously, vest 45 includes a flotation reserve 46 preferably provided at neck level. The harness-vest combination provides increased comfort for the user through better distribution of the pulling forces exerted by connecting element 30 upon hook 31 of the plate.

I claim:

1. Improved traction harness, particularly for navigation, and particularly for a sail surfboard type craft, the harness comprising a chest bolt of adjustable length with shoulder straps adjustable to the size of the user, the belt being provided on the belly side with a rigid plate having an attachment point for a connecting element releaseable by the user, the connecting element having one extremity adapted to be attached to said point and another extremity attached to a part of the craft, and a rip cord adapted to be connected to a body extremity of the user, the improved harness being characterized in that the attachment point to the plate for the releaseable connecting element is formed by an open hook having an operating shank and a retaining portion for the connecting element, the hook being positioned in a vertical slot provided in the plate in such manner that the retaining portion of the hook which receives the connecting element is oriented to protrude from the outer face of the plate, the said hook being pivotally attached through the vertical slot in the plate, so as to be capable of assuming either of two distinct positions, a hooking-on position for the connecting element in which position the retaining portion and the operating shank of the said hook are approximately parallel to the plane of the plate, and a release position for the said connecting element in which position the retaining portion and the operating shank of the said hook are approximately perpendicular to the plane of the plate, the said rip cord being coupled to the hook shank so that simple pulling on the cord by the user causes the hook to assume the said release position, thereby freeing the connecting element.

2. Traction harness according to claim 1 characterized in that the pivot axis of the hook for the connecting element is positioned above the point at which said connecting element exerts its pull upon the hook, whereby pull from the connecting element produces a couple tending to cause the hook to pivot from the hooking-on position to the release position, and a control latch for maintaining the hook in the hooking-on position, said control latch taking the form of a two-branch lever, one branch providing the latch and one the control, the lever being coupled to the said rip cord and pivotable about an axis in a plane parallel to the plane of the plate in response to movement of the rip cord, the lever being capable of occupying two positions, one of operating in which the latching branch partially closes the slot in the plate to provide an arresting member for the shank of the pivotable hook, the other of release in which the latching branch permits free passage for the hook shank to pivot through the slot in the plate.

3. Traction harness according to claim 2 further comprising a restoring means for exerting upon the latching branch of the control latch lever a couple urging the lever towards its operating position after each release, the shank of the pivotable hook having an operating ramp for contacting the latching branch of the pivotable lever and positioned so that, after each release and passage of the hook shank, the said ramp of the hook shank responds to pivoting of the latching branch to enable said latching branch to reassume its operating position in front of the slot for the pivotable hook.

4. Traction harness according to claim 1 further comprising an elastic restraining means for the pivotable hook of the plate the restoring means tending to continuously restore the pivotable hook into its operating position inside the slot of plate, and a bridge straddling the hooked shank to form on the belly face of the plate a restraining element for said shank when it assumes a position substantially parallel to the plane of the plate.

5. Traction harness according to claim 1 characterized in that the chest belt is constituted by two opposing segments connected in adjustable manner to the chest plate, each section extending from said plate towards the back, bearing first upon the chest then passing under the arm to diagonally traverse the back, each section then passing over the shoulder to form shoulder straps which are attached by encircling opposing segments of the belt.

6. Traction harness according to claim 1 characterized in that the pivot axis of the hook is positioned upon the shank below the level of the point at which said connecting element exerts its pull upon the retaining portion of the hook, whereby pull from the connecting element subjects the hook to a rotational couple holding the hook shank against the bottom portion of the plate, the relationship of the lever arms on one side and the other of the pivot axis of the hook being at least equal to or exceeding two to one between the shank and the retaining portion, the rip cord having one end attached directly to the lower end of the hook shank, thereby being adapted to cause the hook to assume its release position.

7. Traction harness according to claim 1 characterized in that it takes the form of a protective and insulating vest, the chest belt and shoulder straps being positioned upon the vest, and a flotation reserve being provided upon that vest preferably at neck level.

8. The harness of claim 1 wherein the connecting element is an elastic or inelastic loop.

9. The harness of claim 1 wherein the craft has tackle and the part of the craft to which the other extremity of the connecting element is attached is a part of the said tackle.

10. The harness of claim 4 wherein the elastic restoring means is a spiral spring encircling the pivot axis of the hook.

* * * * *